US007163911B2

(12) United States Patent
Boons et al.

(10) Patent No.: US 7,163,911 B2
(45) Date of Patent: Jan. 16, 2007

(54) CARBOXYLATED DETERGENT-DISPERSANT ADDITIVE FOR LUBRICATING OILS

(75) Inventors: Cornelius Hendrikus Boons, Breda (NL); Eugene Spala, Fairfield, CA (US); Willem Van Dam, Novato, CA (US)

(73) Assignees: Chevron Oronite Company LLC, San Ramon, CA (US); Cherov Oronite Technology B.V., Rotterdam (NL)

( * ) Notice: Subject to any disclaimer, the term of this patent is extended or adjusted under 35 U.S.C. 154(b) by 642 days.

(21) Appl. No.: 10/444,764

(22) Filed: May 22, 2003

(65) Prior Publication Data

US 2004/0235686 A1 Nov. 25, 2004

(51) Int. Cl.
*C10M 159/22* (2006.01)
*C10M 129/00* (2006.01)

(52) U.S. Cl. ..... 508/460; 508/518; 508/583; 508/584; 508/586

(58) Field of Classification Search ..... 508/460, 508/518
See application file for complete search history.

(56) References Cited

U.S. PATENT DOCUMENTS

| | | | | |
|---|---|---|---|---|
| 3,036,971 A | | 5/1962 | Otto | |
| 3,372,116 A | * | 3/1968 | Meinhardt | 508/460 |
| 3,755,170 A | | 8/1973 | Rogers et al. | |
| 4,435,301 A | | 3/1984 | Brannen et al. | |
| 4,514,313 A | | 4/1985 | Le Coent | |
| 4,810,398 A | | 3/1989 | Van Kruchten et al. | |
| 5,030,687 A | * | 7/1991 | Leone | 508/460 |
| 5,330,665 A | | 7/1994 | Cane et al. | |
| 5,458,790 A | * | 10/1995 | Cane et al. | 508/453 |
| 5,726,133 A | | 3/1998 | Blahey et al. | |
| 5,942,476 A | | 8/1999 | Campbell | |
| 6,140,281 A | | 10/2000 | Blahey et al. | |
| 6,147,035 A | | 11/2000 | Sougawa et al. | |
| 6,162,770 A | | 12/2000 | Le Coent et al. | |
| 6,262,001 B1 | | 7/2001 | Le Coent et al. | |
| 6,348,438 B1 | | 2/2002 | Le Coent et al. | |
| 6,391,833 B1 | * | 5/2002 | Ilmain et al. | 508/518 |
| 6,642,190 B1 | * | 11/2003 | Hammond et al. | 508/460 |
| 6,784,143 B1 | * | 8/2004 | Locke et al. | 508/460 |

FOREIGN PATENT DOCUMENTS

| | | |
|---|---|---|
| EP | 0 675 191 A2 | 10/1995 |
| EP | 0933417 A1 | 8/1999 |
| FR | 1563557 | 11/1968 |
| FR | 2625220 | 7/1991 |
| GB | 0 759 344 | 10/1956 |
| GB | 786167 | 11/1957 |
| GB | 790473 | 2/1958 |
| GB | 1146925 | 3/1969 |
| WO | WO 95/25155 | 9/1995 |
| WO | WO 97/31991 | 9/1997 |

* cited by examiner

*Primary Examiner*—Ellen M. McAvoy
(74) *Attorney, Agent, or Firm*—Sarita R. Kelley

(57) ABSTRACT

The present invention provides a novel unsulfurized, carboxylate-containing additive for lubricating oils, comprising a mixture of alkaline earth metal salts (hydrocarbyl phenate/hydrocarbyl salicylate) and a reduced amount of unreacted hydrocarbyl phenols, as well as additive packages, concentrates and finished oil compositions comprising the same. Specifically, it relates to additives comprising said mixture in which said hydrocarbyl salicylate is primarily single-aromatic-ring hydrocarbyl salicylate. The invention also provides a method for producing said additive.

42 Claims, No Drawings

CARBOXYLATED DETERGENT-DISPERSANT ADDITIVE FOR LUBRICATING OILS

FIELD OF THE INVENTION

The present invention relates to a novel unsulfurized, carboxylate-containing additive for lubricating oils, comprising a mixture of alkaline earth metal salts (hydrocarbyl phenate/hydrocarbyl salicylate) and a reduced amount of unreacted hydrocarbyl phenols, as well as additive packages, concentrates and finished oil compositions comprising the same. Specifically, it relates to additives comprising said mixture in which said hydrocarbyl salicylate is primarily single-aromatic-ring hydrocarbyl salicylate. This additive improves antioxidant properties, high temperature deposit control, BN retention, corrosion control and black sludge control in lubricating oils. This invention is also directed, in part, to methods of preparing and using said novel additive.

BACKGROUND OF THE INVENTION

The preparation of hydrocarbyl phenates and hydrocarbyl salicylates is well known in the art.

U.S. Pat. No. 3,036,971 discloses preparing detergent dispersant additives based on sulfurized alkylphenates of high basicity alkaline earth metals. These additives are prepared by sulfurization of an alkylphenol, neutralization of the sulfurized alkylphenol with an alkaline earth metal base, then super-alkalization by carbonation of the alkaline earth metal base dispersed in the sulfurized alkylphenate.

French patent 1,563,557 discloses detergent additives based on sulfurized calcium alkylsalicylates. These additives are prepared by carboxylation of a potassium alkylphenate, exchange with calcium chloride, then sulfurization of the calcium alkylsalicylate obtained with sulfur in the presence of lime, a carboxylic acid and an alkylene glycol or alkyl ether of alkylene glycol.

French patent application 2,625,220 discloses superalkalized detergent-dispersant additives based on alkylphenates and alkylsalicylates. These additives are prepared by neutralization of an alkylphenol with an alkaline earth metal base in the presence of an acid and a solvent, distillation of the solvent, carboxylation, sulfurization and superalkalization by sulfur and an alkaline earth metal base in the presence of glycol and solvent, followed by carbonation and filtration.

PCT Patent Application Publication No. WO 95/25155 discloses a process that is able to improve substantially the performance of these additives, particularly in the tests relating to foaming, compatibility and dispersion in a new oil, and in the tests of stability towards hydrolysis. This process comprises neutralization with alkaline earth metal base of a mixture of linear and branched alkylphenols in the presence of a carboxylic acid, carboxylation by the action of carbon dioxide of the alkylphenate, followed by sulfurization and super-alkalization, then carbonation, distillation, filtration, and degassing in air.

European Patent Application Publication No. 0933417 discloses an unsulfurized, alkali metal-free detergent-dispersant additive, comprising a mixture of alkaline earth metal salts (alkylphenate/alkylsalicylate) and unreacted alkylphenol. This additive improves antioxidant properties, high temperature deposit control, and black sludge control.

U.S. Pat. Nos. 6,162,770 and 6,262,001 teach an unsulfurized, alkali metal-free, detergent-dispersant composition having from 40% to 60% alkylphenol, from 10% to 40% alkaline earth alkylphenate, and from 20% to 40% alkaline earth single-aromatic-ring alkylsalicylate, and a process for preparing the same. This composition may have an alkaline earth double-aromatic-ring alkylsalicylate as long as the mole ratio of single-ring alkylsalicylate to double-aromatic-ring alkylsalicylate is at least 8:1. This composition may be produced by the three-step process involving neutralization of alkylphenols, carboxylation of the resulting alkylphenate, and filtration of the product of the carboxylation step. The detergent-dispersant produced by the method can be used in an engine lubricating composition to improve antioxidant properties, high temperature deposit control, and black sludge control.

SUMMARY OF THE INVENTION

The present invention provides a novel unsulfurized, carboxylate-containing additive for lubricating oils, comprising a mixture of alkaline earth metal salts (hydrocarbyl phenate/hydrocarbyl salicylate) and a reduced amount of unreacted hydrocarbyl phenols, as well as additive packages, concentrates and finished oil compositions comprising the same. Specifically, it relates to additives comprising said mixture in which said hydrocarbyl salicylate is primarily single-aromatic-ring hydrocarbyl salicylate.

The present invention also provides a method for producing the above described additive, which comprises the neutralization of hydrocarbyl phenols using an alkaline earth base in the presence of a promoter to produce a hydrocarbyl phenate. Preferably, said promoter comprises at least one carboxylic acid containing from one to four carbon atoms, and said neutralization step is carried out in the absence of alkali base, in the absence of dialcohol, and in the absence of monoalcohol. The neutralization step is followed by carboxylation of the hydrocarbyl phenate produced in the neutralization step; and separation of the starting hydrocarbyl phenols from the product of the carboxylation step.

The hydrocarbyl phenols may comprise a mixture of linear and/or branched hydrocarbyl constituents. For example, the hydrocarbyl phenols may be made up entirely of linear hydrocarbyl phenol, entirely of branched hydrocarbyl phenol, or a mixture of both. Preferably, the hydrocarbyl phenols contain up to 85% of linear hydrocarbyl phenol in mixture with at least 15% of branched hydrocarbyl phenol in which the branched hydrocarbyl radical contains at least nine carbon atoms. More preferably, the hydrocarbyl phenols are alkylphenols which contain from 35% to 85% of linear alkylphenol in mixture with from 15% to 65% of branched alkylphenol. The ratio of branched versus linear alkylphenol is given by weight. Preferably, the linear hydrocarbyl radical contains 12 to 40 carbon atoms, more preferably from 18 to 30 carbon atoms, and, if branched hydrocarbyl phenols are present, the branched hydrocarbyl radical contains at least 9 carbon atoms, preferably from 9 to 24 carbon atoms, more preferably 10 to 15 carbon atoms.

Preferably, the alkaline earth base is selected from the group consisting of calcium oxide, calcium hydroxide, magnesium oxide, and mixtures thereof.

Preferably, the carboxylic acid is a mixture of formic acid and acetic acid, more preferably a 50/50 by weight mixture of formic and acetic acid.

Preferably, the neutralization step is carried out at a temperature of at least 200° C., more preferably at least 215° C. The pressure is reduced gradually below atmospheric in order to remove the water of reaction, in the absence of any solvent that may form an azeotrope with water. Preferably, the quantities of reagents used correspond to the following molar ratios:

(1) alkaline earth base/alkylphenol of from 0.2:1 to 0.7:1, more preferably from 0.3:1 to 0.5:1; and (2) carboxylic acid/alkylphenol of from 0.01:1 to 0.5:1, more preferably from 0.03:1 to 0.15:1.

In one embodiment, the neutralization step is carried out at a temperature of at least 240° C. with a gradual reduction in pressure below atmospheric so as to reach a pressure of no more than 7,000 Pa (70 mbars) at 240° C.

The hydrocarbyl phenate obtained in the neutralization step is carboxylated in order to convert at least 20 mole % of the starting hydrocarbyl phenols to hydrocarbyl salicylate using carbon dioxide under carboxylation conditions. Preferably, at least 22 mole % of the starting hydrocarbyl phenols is converted, and this conversion occurs at a temperature between 180° C. and 240° C., under a pressure within the range of from above atmospheric pressure to $15\times10^5$ Pa (15 bars) for a period of one to eight hours.

More preferably, the starting hydrocarbyl phenols are alkylphenols and at least 25 mole % of the starting alkylphenols is converted to alkylsalicylate using carbon dioxide at a temperature equal to or greater than 200° C., under a pressure of $4\times10^5$ Pa (4 bars).

The hydrocarbyl salicylate produced in the carboxylation step carboxylation step may comprise both single-aromatic-ring hydrocarbyl salicylate and double-aromatic-ring hydrocarbyl salicylate. Preferably, the mole ratio of single-aromatic-ring hydrocarbyl salicylate to double-aromatic-ring hydrocarbyl salicylate is at least 8:1.

Preferably, the product of the carboxylation step is then filtered to remove any sediment formed in the carboxylation step.

The product of the carboxylation step is then subjected to a separation procedure such as solvent extraction, distillation, membrane filtration, and the like wherein at least about 10% of the starting hydrocarbyl phenols are separated from the product of the carboxylation step. Preferably, at least about 30% to about 55% of the starting hydrocarbyl phenols are separated. More preferably, at least about 45% to about 50% of the starting hydrocarbyl phenols are separated from the product of the carboxylation step.

Once the starting hydrocarbyl phenols are separated from the product of the carboxylation step, said hydrocarbyl phenols may advantageously be recycled to be used as starting materials in the process of the present invention or in any other process.

Preferably, the separation step is performed via distillation, more preferably via falling film distillation or short path distillation, most preferably via wiped film evaporator distillation. Said distillation is carried out at a temperature of from about 150° C. to about 250° C. and at a pressure of about 0.1 to about 4 mbar; more preferably from about 190° C. to about 230° C. and at about 0.5 to about 3 mbar; most preferably from about 195° C. to about 225° C. and at a pressure of about 1 to about 2 mbar.

The unsulfurized, carboxylate-containing additive of the present invention may advantageously be blended with an effective viscosity improving amount of organic diluent. Preferably, enough diluent is added so that said diluent makes up from about 10% to about 80% by weight of the blended product. More preferably, said diluent makes up from about 20% to about 50% by weight of the blended product. Suitable diluents include Group 1 or Group 2 base oils such as 100N base oil; organic solvents such as pentane, heptane, benzene, toluene and the like; and other suitable organic compounds such as hydrocarbyl phenols which may advantageously be recycled from the distillation step of the present invention.

The unsulfurized, carboxylate-containing additive produced by this method has the following composition:

(a) less than 40% hydrocarbyl phenol, (b) 10% to 50% alkaline earth metal hydrocarbyl phenate, (c) 15% to 60% alkaline earth metal single-aromatic-ring hydrocarbyl salicylate, and (d) 0% to 50% organic diluent.

In one embodiment, the unsulfurized carboxylate-containing additive comprises from 0 to 35% hydrocarbyl phenol; preferably from 0 to 30% hydrocarbyl phenol; more preferably from 0 to 20% hydrocarbyl phenol; most preferably from 0 to 15% hydrocarbyl phenol.

The unsulfurized, carboxylate-containing additive may also comprise an alkaline earth metal double-aromatic-ring hydrocarbyl salicylate, but the mole ratio of single-aromatic-ring hydrocarbyl salicylate to double-aromatic-ring hydrocarbyl salicylate will be at least 8:1.

The unsulfurized, carboxylate-containing additive produced by the method of the present invention can be used in an engine lubricating oil composition containing a major part of lubricating oil, from 1% to 30% of the unsulfurized, carboxylate-containing additive of the present invention, and preferably at least one other additive. Examples of other additives that may be used include metal-containing detergents, ashless dispersants, oxidation inhibitors, rust inhibitors, demulsifiers, extreme pressure agents, friction modifiers, multifunctional additives, viscosity index improvers, pour point depressants, and foam inhibitors.

The unsulfurized, carboxylate-containing additive produced by the method of the present invention has been found to be particularly useful when used in an engine lubricating oil composition in combination with at least one of the following: a phenate, a phenate-stearate, a salicylate, and a carboxy-stearate. Preferably, the mass ratio of phenate to unsulfurized, carboxylate-containing additive in said composition is from 1:0.035 to 1:98; more preferably from 1:0.239 to 1:14; most preferably from 1:0.451 to 1:7.5. Preferably, the mass ratio of phenate-stearate to unsulfurized, carboxylate-containing additive in said composition is from 1:0.051 to 1:126; more preferably from 1:0.353 to 1:12; most preferably from 1:0.667 to 1:9.7. Preferably, the mass ratio of salicylate to unsulfurized, carboxylate-containing additive in said composition is from 1:0.026 to 1:120; more preferably from 1:0.178 to 1:17; most preferably from 1:0.335 to 1:9.2. Preferably, the salicylate is a high-overbased salicylate. Preferably, the mass ratio of carboxy-stearate to unsulfurized, carboxylate-containing additive in said composition is from 1:0.023 to 1:105; more preferably from 1:0.156 to 1:15; most preferably from 1:0.294 to 1:8.1.

In marine applications, the black sludge deposit control, high temperature deposit control, viscosity increase control and demulsibility performance of a lubricating oil can be improved by adding to the lubricating oil an effective amount of the unsulfurized, carboxylate-containing additive of the present invention.

In automotive applications, the high temperature deposit control performance, corrosion control and oxidation inhibition performance of a lubricating oil can be improved by adding to the lubricating oil an effective amount of the unsulfurized, carboxylate-containing additive of the present invention.

The invention also provides a hydraulic oil composition with improved filterability containing a base oil of lubricating viscosity, from 0.1% to 6% of the unsulfurized, carboxylate-containing additive of the present invention, and preferably at least one other additive.

The invention also provides a concentrate comprising the unsulfurized, carboxylate-containing additive of the present invention, an organic diluent, and preferably at least one other additive. The organic diluent constitutes from 20% to 80% of the concentrate. Examples of other additives that may be used include metal-containing detergents, ashless dispersants, oxidation inhibitors, rust inhibitors, demulsifiers, extreme pressure agents, friction modifiers, multifunctional additives, viscosity index improvers, pour point depressants, and foam inhibitors.

DETAILED DESCRIPTION OF THE INVENTION

In its broadest aspect, the present invention provides an unsulfurized, carboxylate-containing additive comprising hydrocarbyl phenol, alkaline earth metal hydrocarbyl phenate, and alkaline earth metal single-aromatic-ring hydrocarbyl salicylate useful for improving BN retention, corrosion performance, bulk oxidation, high temperature deposit control, black sludge control, thermal oxidation stability, and other properties of a lubricating oil.

Prior to discussing the invention in further detail, the following terms will be defined:

Definitions

As used herein the following terms have the following meanings unless expressly stated to the contrary:

The term "hydrocarbyl" means an alkyl or alkenyl group.

The term "metal" means alkali metals, alkaline earth metals, or mixtures thereof.

The term "alkaline earth metal" means calcium, barium, magnesium, strontium, or mixtures thereof.

The term "salicylate" means a metal salt of a salicylic acid.

The term "alkaline earth metal single-aromatic-ring hydrocarbyl salicylate" means an alkaline earth metal salt of a hydrocarbyl salicylic acid, wherein there is only one hydrocarbyl salicylic anion per each alkaline earth metal base cation.

The term "alkaline earth metal single-aromatic-ring alkylsalicylate" means an alkaline earth metal single-aromatic-ring hydrocarbyl salicylate wherein the hydrocarbyl group is an alkyl group.

The term "alkaline earth metal double-aromatic-ring hydrocarbyl salicylate" means an alkaline earth metal salt of a hydrocarbyl salicylic acid, wherein there are two hydrocarbyl salicylic anions per each alkaline earth metal base cation.

The term "alkaline earth metal double-aromatic-ring alkylsalicylate" means an alkaline earth metal double-aromatic-ring hydrocarbyl salicylate wherein the hydrocarbyl groups are alkyl groups.

The term "hydrocarbyl phenol" means a phenol having one or more hydrocarbyl substituents; at least one of which has a sufficient number of carbon atoms to impart oil solubility to the phenol.

The term "alkylphenol" means a phenol having one or more alkyl substituents, wherein at least one of the alkyl substituents has a sufficient number of carbon atoms to impart oil solubility to the phenol.

The term "phenate" means a metal salt of a phenol.

The term "hydrocarbyl phenate" means a metal salt of a hydrocarbyl phenol.

The term "alkaline earth metal hydrocarbyl phenate" means an alkaline earth metal salt of a hydrocarbyl phenol.

The term "alkaline earth metal alkylphenate" means an alkaline earth metal salt of an alkylphenol.

The term "phenate-stearate" means a phenate that has been treated with stearic acid or anhydride or salt thereof.

The term "long-chain carboxylic acid" means a carboxylic acid having an alkyl group having an average carbon number of from 13 to 28. The alkyl group may be linear, branched, or mixtures thereof.

The term "carboxy-stearate" means an alkaline earth metal single-aromatic-ring hydrocarbyl salicylate that has been treated with a long-chain carboxylic acid, anhydride or salt thereof.

The term "Base Number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

Unless otherwise specified, all percentages are in weight percent.

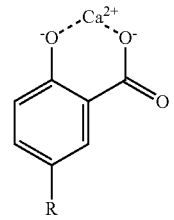

single aromatic ring hydrocarbyl salicylate

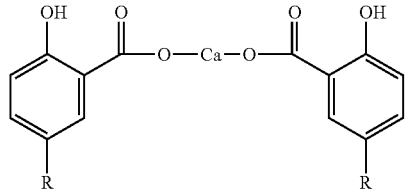

double aromatic ring hydrocarbyl salicylate

Preparation of the Lubricant Additive Compositon

A. Neutralization Step

In the first step, hydrocarbyl phenols are neutralized in the presence of a promoter. In one embodiment, said hydrocarbyl phenols are neutralized using an alkaline earth metal base in the presence of at least one $C_1$ to $C_4$ carboxylic acid. Preferably, this reaction is carried out in the absence of alkali base, and in the absence of dialcohol or monoalcohol.

The hydrocarbyl phenols may contain up to 100% linear hydrocarbyl groups, up to 100% branched hydrocarbyl groups, or both linear and branched hydrocarbyl groups. Preferably, the linear hydrocarbyl group, if present, is alkyl, and the linear alkyl radical contains 12 to 40 carbon atoms, more preferably 18 to 30 carbon atoms. The branched hydrocarbyl radical, if present, is preferably alkyl and contains at least nine carbon atoms, preferably 9 to 24 carbon atoms, more preferably 10 to 15 carbon atoms. In one embodiment, the hydrocarbyl phenols contain up to 85% of linear hydrocarbyl phenol (preferably at least 35% linear hydrocarbyl phenol) in mixture with at least 15% of branched hydrocarbyl phenol.

The use of an alkylphenol containing at least 35% of long-chain linear alkylphenol (from 18 to 30 carbon atoms) is particularly attractive because a long linear alkyl chain promotes the compatibility and solubility of the additives in lubricating oils. However, the presence of relatively heavy linear alkyl radicals in the alkylphenols can make the latter less reactive than branched alkylphenols, hence the need to use harsher reaction conditions to bring about their neutralization by an alkaline earth metal base.

Branched alkylphenols can be obtained by reaction of phenol with a branched olefin, generally originating from propylene. They consist of a mixture of monosubstituted isomers, the great majority of the substituents being in the para position, very few being in the ortho position, and hardly any in the meta position. That makes them relatively more reactive towards an alkaline earth metal base, since the phenol function is practically devoid of steric hindrance.

On the other hand, linear alkylphenols can be obtained by reaction of phenol with a linear olefin, generally originating from ethylene. They consist of a mixture of monosubstituted isomers in which the proportion of linear alkyl substituents in the ortho, para, and meta positions is more uniformly distributed. This makes them less reactive towards an alkaline earth metal base since the phenol function is less accessible due to considerable steric hindrance, due to the presence of closer and generally heavier alkyl substituents. Of course, linear alkylphenols may contain alkyl substituents with some branching which increases the amount of para substituents and, resultantly, increases the relative reactivity towards alkaline earth metal bases.

The alkaline earth metal bases that can be used for carrying out this step include the oxides or hydroxides of calcium, magnesium, barium, or strontium, and particularly of calcium oxide, calcium hydroxide, magnesium oxide, and mixtures thereof. In one embodiment, slaked lime (calcium hydroxide) is preferred.

The promoter used in this step can be any material that enhances neutralization. For example, the promoter may be a polyhydric alcohol, dialcohol, monoalcohol, ethylene glycol or any carboxylic acid. Preferably, a carboxylic acid is used. More preferably, $C_1$ to $C_4$ carboxylic acids are used in this step including, for example, formic, acetic, propionic and butyric acid, and may be used alone or in mixture. Preferably, a mixture of acids is used, most preferably a formic acid/acetic acid mixture. The molar ratio of formic acid/acetic acid should be from 0.2:1 to 100:1, preferably between 0.5:1 and 4:1, and most preferably 1:1. The carboxylic acids act as transfer agents, assisting the transfer of the alkaline earth metal bases from a mineral reagent to an organic reagent.

The neutralization operation is carried out at a temperature of at least 200° C., preferably at least 215° C., and more preferably at least 240° C. The pressure is reduced gradually below atmospheric in order to distill off the water of reaction. Accordingly the neutralization should be conducted in the absence of any solvent that may form an azeotrope with water. Preferably, the pressure is reduced to no more than 7,000 Pa (70 mbars).

The quantities of reagents used should correspond to the following molar ratios:

(1) alkaline earth metal base/hydrocarbyl phenol of 0.2:1 to 0.7:1, preferably 0.3:1 to 0.5:1; and (2) carboxylic acid/hydrocarbyl phenol of 0.01:1 to 0.5:1, preferably from 0.03:1 to 0.15:1.

Preferably, at the end of this neutralization step the hydrocarbyl phenate obtained is kept for a period not exceeding fifteen hours at a temperature of at least 215° C. and at an absolute pressure of between 5,000 and $10^5$ Pa (between 0.05 and 1.0 bar). More preferably, at the end of this neutralization step the hydrocarbyl phenate obtained is kept for between two and six hours at an absolute pressure of between 10,000 and 20,000 Pa (between 0.1 and 0.2 bar).

By providing that operations are carried out at a sufficiently high temperature and that the pressure in the reactor is reduced gradually below atmospheric, the neutralization reaction is carried out without the need to add a solvent that forms an azeotrope with the water formed during this reaction.

B. Carboxylation Step

The carboxylation step is conducted by simply bubbling carbon dioxide into the reaction medium originating from the preceding neutralization step and is continued until at least 20 mole % of the starting hydrocarbyl phenols is converted to hydrocarbyl salicylate (measured as salicylic acid by potentiometric determination). It must take place under pressure in order to avoid any decarboxylation of the alkylsalicylate that forms.

Preferably, at least 22 mole % of the starting hydrocarbyl phenols is converted to hydrocarbyl salicylate using carbon dioxide at a temperature of between 180° C. and 240° C., under a pressure within the range of from above atmospheric pressure to $15\times10^5$ Pa (15 bars) for a period of one to eight hours.

According to one variant, at least 25 mole % of the starting hydrocarbyl phenols is converted to hydrocarbyl salicylate using carbon dioxide at a temperature equal to or greater than 200° C. under a pressure of $4\times10^5$ Pa (4 bars).

C. Filtration Step

The product of the carboxylation step may advantageously be filtered. The purpose of the filtration step is to remove sediments, and particularly crystalline calcium carbonate, which might have been formed during the preceding steps, and which may cause plugging of filters installed in lubricating oil circuits.

D. Separation Step

At least 10% of the starting hydrocarbyl phenol is separated form the product of the carboxylation step. Preferably, the separation is accomplished using distillation. More preferably, the distillation is carried out in a wiped film evaporator at a temperature of from about 150° C. to about 250° C. and at a pressure of about 0.1 to about 4 mbar; more preferably from about 190° C. to about 230° C. and at about 0.5 to about 3 mbar; most preferably from about 195° C. to about 225° C. and at a pressure of about 1 to about 2 mbar. At least 10% of the starting hydrocarbyl phenol is separated. More preferably, at least 30% of the starting hydrocarbyl phenol is separated. Most preferably, up to 55% of the starting hydrocarbyl phenol is separated. The separated hydrocarbyl phenol may then be recycled to be used as starting materials in the novel process or in any other process.

Unsulfurized, Carboxylate-Containing Additve

The unsulfurized, carboxylate-containing additive formed by the present process can be characterized by its unique composition, with much more alkaline earth metal single-aromatic-ring hydrocarbyl salicylate and less hydrocarbyl phenol than produced by other routes. When the hydrocarbyl group is an alkyl group, the unsulfurized, carboxylate-containing additive has the following composition;

(a) less than 40% alkylphenol, (b) from 10% to 50% alkaline earth metal alkylphenate, and (b) from 15% to 60% alkaline earth metal single-aromatic-ring alkylsalicylate.

Unlike alkaline earth metal alkylsalicylates produced by other process, this unsulfurized, carboxylate-containing additive composition can be characterized by having only minor amounts of an alkaline earth metal double-aromatic-ring alkylsalicylates. The mole ratio of single-aromatic-ring alkylsalicylate to double-aromatic-ring alkylsalicylate is at least 8:1.

Characterization of the Product by Infrared Spectrometry

Out-of-aromatic-ring-plane C-H bending vibrations were used to characterize the unsulfurized carboxylate-containing additive of the present invention. Infrared spectra of aromatic rings show strong out-of-plane C-H bending transmittance band in the 675–870 $cm^{-1}$ region, the exact frequency depending upon the number and location of substituents. For ortho-disubstituted compounds, transmittance band occurs at 735–770 $cm^{-1}$. For para-disubstituted compounds, transmittance band occurs at 810–840 $cm^{-1}$.

Infrared spectra of reference chemical structures relevant to the present invention indicate that the out-of-plane C-H bending transmittance band occurs at 750±3 $cm^{-1}$ for ortho-alkylphenols, at 760±2 $cm^{-1}$ for salicylic acid, and at 832+3 $cm^{-1}$ for para-alkylphenols.

Alkaline earth alkylphenates known in the art have infrared out-of-plane C-H bending transmittance bands at 750±3 $cm^{-1}$ and at 832±3 $cm^{-1}$. Alkaline earth alkylsalicylates known in the art have infrared out-of-plane C-H bending transmittance bands at 763±3 $cm^{-1}$ and at 832±3 $cm^{-1}$.

The unsulfurized carboxylate-containing additive of the present invention shows essentially no out-of-plane C-H bending vibration at 763±3 $cm^{-1}$, even though there is other evidence that alkylsalicylate is present. This particular characteristic has not been fully explained. However, it may be hypothesized that the particular structure of the single aromatic ring alkylsalicylate prevents in some way this out-of-plane C-H bending vibration. In this structure, the carboxylic acid function is engaged in a cyclic structure, and thus may generate increased steric hindrance in the vicinity of the aromatic ring, limiting the free motion of the neighbor hydrogen atom. This hypothesis is supported by the fact that the infrared spectrum of the acidified product (in which the carboxylic acid function is no longer engaged in a cyclic structure and thus can rotate) has an out-of-plane C-H transmittance band at 763±3 $cm^{-1}$.

The unsulfurized carboxylate-containing additive of the present invention can thus be characterized by having a ratio of infrared transmittance band of out-of-plane C-H bending at about 763±3 $cm^{-1}$ to out-of-plane C-H bending at 832±3 $cm^{-1}$ of less than 0.1:1.

The unsulfurized, carboxylate-containing additive formed by this method, being non-sulfurized, would provide improved high temperature deposit control performance over sulfurized products. Being alkali-metal free, this additive can be employed as a detergent-dispersant in applications, such as marine engine oils, where the presence of alkali metals have proven to have harmful effects.

Detergents

The unsulfurized, carboxylate-containing additive formed by the process described above has been found to provide improved bulk oxidation and corrosion control performance when combined with other additives, including detergents.

Detergents help control varnish, ring zone deposits, and rust by keeping insoluble particles in colloidal suspension. Metal-containing (or ash-forming detergents) function both as detergents to control deposits, and as acid neutralizers or rust inhibitors, thereby reducing wear and corrosion and extending engine life. Detergents generally comprise a polar head with a long hydrophobic tail; with the polar head comprising a metal salt of an acidic organic compound. The salts may contain a substantially stoichiometric amount of the metal in which case they are usually described as normal or neutral salts, and would typically have a total base number (as measured by ASTM D2896) of from 0 to 10. It is possible to include large amounts of a metal base by reacting an excess of a metal compound such as an oxide or hydroxide with an acidic gas such as carbon dioxide to form an overbased detergent. Such overbased detergents may have a total base number of about 15 to 30 (low overbased); 31 to 170 (medium overbased); 171 to 400 (high overbased); or above 400 (high-high overbased).

Detergents that may be used include phenates, overbased phenates and sulfurized phenates; phenate-carboxylates, and overbased phenate-carboxylates; carboxy-stearates and overbased carboxy-stearates; and low, medium and high overbased salicylates. Suitable metals include the alkali or alkaline earth metals, e.g., sodium, potassium, lithium, calcium, and magnesium. The most commonly used metals are calcium and magnesium, which may both be present in detergents used in a lubricant.

Preparation of Phenates

The phenates which may be used in the present invention are typically hydrocarbyl substituted phenates in which the hydrocarbyl substituent or substituents of the phenate are preferably one or more alkyl group, either branched or unbranched. Suitable alkyl groups contain from 4 to 50, preferably from 9 to 28 carbon atoms. Particularly suitable alkyl groups are $C_{12}$ groups derivable from propylene tetramer. The hydrocarbyl substituted phenates are typically sulfurized.

According to one preferred embodiment of the present invention, overbased sulfurized alkylphenates of alkaline earth metals are prepared by neutralizing a sulfurized alkylphenol with an alkaline earth base in the presence of a dilution oil, a glycol, and halide ions, the glycol being present in the form of a mixture with an alcohol having a boiling point above 150° C., removing alcohol, glycol, water, and sediment, carbonating the reaction medium with $CO_2$ in the presence of halide ions, and again removing alcohol, glycol, water, and sediment.

In another preferred embodiment, an overbased, sulfurized hydrocarbyl phenate is prepared by a process comprising the steps of:

(a) neutralizing a sulfurized alkylphenol with an alkaline earth base in the presence of a dilution oil, a glycol, and halide ions, the glycol being present in the form of a mixture with an alcohol having a boiling point above 150° C.;

(b) removing alcohol, glycol, and water from the medium, preferably by distillation;

(c) removing sediment from the medium, preferably by filtration;

(d) carbonating the resultant medium with $CO_2$ in the presence of halide ions; and (e) removing alcohol, glycol, and water from the medium, preferably by distillation.

The alkaline earth bases useful in the above process include the oxides and hydroxides of barium, strontium, and calcium, particularly lime. Alcohols with a boiling point above 150° C. useful in the process include alcohols of $C_6$ to $C_{14}$ such as ethylhexanol, oxoalcohol, decylalcohol, tridecylalcohol; alkoxyalcohols such as 2-butoxyethanol, 2-butoxypropanol; and methyl ethers of dipropylene glycol. The amines useful in the process include polyaminoalkanes, preferably polyaminoethanes, particularly ethylenediamine, and aminoethers, particularly tris(3-oxa-6-amino-hexyl) amine. The glycols useful in the process include alkylene glycols, particularly ethylene glycol. The halide ions employed in the process are preferably $Cl^-$ ions which may be added in the form of ammonium chloride or metal chlorides such as calcium chloride or zinc chloride.

The dilution oils suitable for use in the above process include naphthenic oils and mixed oils and preferably paraffinic oils such as neutral 100 oil. The quantity of dilution oil used is such that the amount of oil in the final product constitutes from about 25% to about 65% by weight of the final product, preferably from about 30% to about 50%.

The process outlined above is more fully described in U.S. Pat. No. 4,514,313, which is incorporated by reference into this application.

Preparation of Phenate-Carboxylates

The phenate-carboxylates which may be used in the present invention are typically hydrocarbyl substituted phenate-carboxylates in which the hydrocarbyl substituent or substituents of the phenate are preferably one or more alkyl group, either branched or unbranched. Suitable alkyl groups contain from 4 to 50, preferably from 9 to 28 carbon atoms. Particularly suitable alkyl groups are $C_{12}$ groups derivable from propylene tetramer. The hydrocarbyl substituted phenate-carboxylates may be sulfurized or unsulfurized.

The overbased hydrocarbyl phenate-carboxylate is prepared from an overbased hydrocarbyl phenate which has been treated, either before, during, or subsequent to overbasing, with a long-chain carboxylic acid (preferably stearic acid), anhydride or salt thereof. That process comprises contacting a mixture of a hydrocarbyl phenate, at least one solvent, metal hydroxide, aqueous metal chloride, and an alkyl polyhydric alcohol containing from one to five carbon atoms, with carbon dioxide under overbasing reaction conditions. Using an aqueous metal chloride, instead of a solid metal chloride, reduces the viscosity of the product. Preferably, the metals are alkaline earth metals, most preferably calcium. Preferably, the alkyl polyhydric alcohol is ethylene glycol.

In a preferred embodiment, the overbased hydrocarbyl phenate-carboxylate is produced by overbasing a hydrocarbyl phenate and treating the phenate (before, during, or after overbasing) with a long-chain carboxylic acid (preferably stearic acid), anhydride or salt thereof.

In the overbasing step, a mixture comprising hydrocarbyl phenate (which can be sulfurized or unsulfurized), at least one solvent, metal hydroxide, aqueous metal chloride, and an alkyl polyhydric alcohol containing from one to five carbon atoms is reacted with carbon dioxide under overbasing reaction conditions. Overbasing reaction conditions include temperatures of from 250 to 375° F. at approximately atmospheric pressure.

Preferably, the overbased hydrocarbyl phenate is a sulfurized alkylphenate. Preferably, the metal is an alkaline earth metal, more preferably calcium. Preferably, the alkyl polyhydric alcohol is ethylene glycol.

The carboxylate treatment (treatment with long-chain carboxylic acid, anhydride, or salt thereof) can occur before, during, or after the overbasing step. It is unimportant when the treatment with long-chain carboxylic acid, anhydride, or salt thereof occurs relative to the overbasing step.

The phenate can be sulfurized or unsulfurized. Preferably, the phenate is sulfurized. If the phenate is sulfurized, the sulfurization step can occur anytime prior to overbasing. More preferably, the phenate is sulfurized before the overbasing step but after the carboxylate treatment.

The process outlined above is more fully described in U.S. Pat. No. 5,942,476, which is incorporated by reference into this application.

Preparation of Salicylates

The preparation of salicylates is well known in the art. Preferred salicylates which may be used in the present invention include medium and high overbased salicylates including salts of polyvalent or monovalent metals, more preferably monovalent, most preferably calcium. As used herein, medium overbased (MOB) is meant to include salicylates with a TBN of about 31 to 170. High overbased (HOB) is meant to include salicylates with a TBN from about 171 to 400. High-high overbased (HHOB) is meant to include salicylates with a TBN over 400.

In one embodiment, salicylates may be prepared, for instance, starting from phenol, ortho-alkylphenol, or para-alkylphenol, by alkylation, carboxylation and salt formation. The alkylating agent preferably chosen is an olefin or a mixture of olefins with more than 12 carbon atoms to the molecule. Acid-activated clays are suitable catalysts for the alkylation of phenol and ortho- and para-alkylphenol. The amount of catalyst employed is, in general, 1–10 wt %, in particular, 3–7 wt %, referred to the sum of the amounts by weight of alkylating agent and phenol to be alkylated. The alkylation may be carried out at temperatures between 100 and 250° C., in particular, between 125 and 225° C.

The alkylphenols prepared via the phenol or ortho- or para-alkylphenol route may be converted into the corresponding alkylsalicylic acids by techniques well known in the art. For instance, the alkylphenols are converted with the aid of an alcoholic caustic solution into the corresponding alkylphenates and the latter are treated with $CO_2$ at about 140° C. and a pressure of 10 to 30 atmospheres. From the alkylsalicylates so obtained, the alkylsalicylic acids may be liberated with the aid of, for example, 30% sulfuric acid.

For the preparation of overbased salicylates, the alkylsalicylic acids may be treated with an excess amount of a metal compound, for instance, calcium in the form of $Ca(OH)_2$.

For example, the alkylsalicylic acids may be treated with 4 equivalents of calcium in the form of $Ca(OH)_2$ with introduction of 1.6 equivalents of $CO_2$.

The preparation of medium and overbased salicylates is more fully described in U.S. Pat. No. 4,810,398, and GB Patents 1,146,925; 790,473; and 786,167, which are incorporated by reference into this application.

Preparation of Carboxy-Stearates

The carboxy-stearates which may be used in the present invention are typically alkaline earth metal single-aromatic-ring hydrocarbyl salicylates that have been treated with a long-chain carboxylic acid, anhydride or salt thereof.

The carboxy-stearate is prepared from a mixture of alkaline earth metal single-aromatic-ring salicylate, at least one solvent, and alkaline earth metal hydroxide. The mixture is overbased by contacting the mixture with carbon dioxide in the presence of an alkyl polyhydric alcohol, wherein the alkyl group of the alcohol has from one to five carbon atoms. One such useful alkyl polyhydric alcohol is ethylene glycol.

The process outlined above is more fully described in U.S. Pat. No. 6,348,438, which is incorporated by reference into this application.

Base Oil of Lubricating Viscosity

The base oil of lubricating viscosity used in such compositions may be mineral oil or synthetic oils of viscosity suitable for use in the crankcase of an internal combustion engine. Crankcase base oils ordinarily have a viscosity of about 1300 cSt at 0° F. (−18° C.) to 3 cSt at 210° F. (99° C.). The base oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, penta-erythritol tetracaproate, di-2-ethylhexyl adipate, dilaurylsebacate, and the like.

Complex esters prepared from mixtures of mono and dicarboxylic acids and mono and dihydroxy alkanols can also be used.

Blends of mineral oils with synthetic oils are also useful. For example, blends of 10 to 25% hydrogenated 1-decene trimer with 75 to 90% 150 SUS (100° F.) mineral oil make excellent lubricating oil bases.

Other Additive Components

The following additive components are examples of some components that can be favorably employed in the present invention. These examples of additives are provided to illustrate the present invention, but they are not intended to limit it:

(1) Ashless dispersants: alkenyl succinimides, alkenyl succinimides modified with other organic compounds, and alkenyl succinimides modified with boric acid, alkenyl succinic ester.

(2) Oxidation inhibitors:

(a) Phenol type oxidation inhibitors: 4,4'-methylene bis (2,6-di-tert-butylphenol), 4,4'-bis(2,6-di-tert-butylphenol), 4,4'-bis(2-methyl-6-tert-butylphenol), 2,2'-methylene bis(4-methyl-6-tert-butyl-phenol), 4,4'-butyl idenebis(3-methyl-6-tert-butylphenol), 4,4'-isopropyl-idenebis(2,6-di-tert-butylphenol), 2,2'-methylene-bis(4-methyl-6-nonylphenol), 2,2'-isobutylidene-bis(4,6dimethyl-phenol), 2,2'-methylenebis (4-methyl-6-cyclohexylphenol), 2,6-di-tert-butyl4-methyl-phenol, 2,6-di-tert-butyl4-ethylphenol, 2,4-dimethyl-6-tert-butyl-phenol, 2,6-di-tert-4-(N,N'-dimethyl-aminomethylphenol), 4,4'-thiobis(2-methyl-6-tert-butylphenol), 2,2'-thiobis(4-methyl-6-tert-butylphenol), bis(3-methyl4-hydroxy-5-tert-butyl benzylysulfide, and bis (3,5-di-tert-butyl4-hydroxybenzyl).

(b) Diphenylamine type oxidation inhibitor: alkylated diphenylamine, phenyl-.alpha.-naphthylamine, and alkylated .alpha.-naphthylamine.

(c) Other types: metal dithiocarbamate (e.g., zinc dithiocarbamate), molybdenum oxysulfide succinimide complexes, and methylenebis (dibutyl-dithiocarbamate).

(3) Rust inhibitors (Anti-rust agents)

(a) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

(b) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(4) Demulsifiers: addition product of alkylphenol and ethyleneoxide, poloxyethylene alkyl ether, and polyoxyethylene sorbitan ester.

(5) Extreme pressure agents (EP agents): zinc dialkyldithiophosphate (aryl zinc, primary alkyl, and secondary alkyl type), sulfurized oils, diphenyl sulfide, methyl trichlorostearate, chlorinated naphthalene, fluoroalkylpolysiloxane, and lead naphthenate.

(6) Friction modifiers: fatty alcohol, fatty acid, amine, borated ester, and other esters.

(7) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound.

(8) Viscosity index improvers: polymethacrylate type polymers, ethylene-propylene copolymers, styrene-isoprene copolymers, hydrated styrene-isoprene copolymers, polyisobutylene, and dispersant type viscosity index improvers.

(9) Pour point depressants: polymethyl methacrylate.

(10) Foam Inhibitors: alkyl methacrylate polymers and dimethyl silicone polymers.

(11) Metal detergents: sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

Lubricating Oil Composition

The unsulfurized, carboxylate-containing additive produced by the process of this invention is useful for imparting detergency to an engine lubricating oil composition. Such a lubricating oil composition comprises a major part of a base oil of lubricating viscosity and an effective amount of the unsulfurized, carboxylate-containing additive of the present invention, typically from about 1% to about 30% by weight, based on the total weight of the lubricating oil composition.

Adding an effective amount the unsulfurized, carboxylate-containing additive of the present invention to a lubricating oil improves the detergency of that lubricating oil in automotive diesel and gasoline engines, as well as in marine engine applications. Such compositions are frequently used in combination with Group II metal detergents, and other additives.

Lubricating marine engines with an effective amount of lubricating oil having the unsulfurized, carboxylate-containing additive of the present invention can control black sludge deposits. It also improves the high temperature deposit control performance and demulsibility performance of that lubricating oil in marine applications.

Adding an effective amount of the unsulfurized, carboxylate-containing additive of the present invention to a lubricating oil improves the high temperature deposit control performance, corrosion control and the oxidation inhibition performance of that lubricating oil in automotive applications.

In one embodiment, an engine lubricating oil composition would contain (a) a major part of a base oil of lubricating viscosity;
(b) 1% to 30% of the unsulfurized, carboxylate-containing additive of the present invention;
(c) 0% to 20% of at least one ashless dispersant;
(d) 0% to 5% of at least one zinc dithiophosphate;
(e) 0% to 10% of at least one oxidation inhibitor;
(f) 0% to 1% of at least one foam inhibitor; and
(g) 0% to 20% of at least one viscosity index improver.

In another embodiment, an engine lubricating oil composition would contain the above components and from 0% to 30% of a metal-containing detergent.

In a further embodiment, an engine lubricating oil composition is produced by blending a mixture of the above components. The lubricating oil composition produced by that method might have a slightly different composition than the initial mixture, because the components may interact. The components can be blended in any order and can be blended as combinations of components.

Hydraulic Oil Composition

A hydraulic oil composition having improved filterability can be formed containing a major part of a base oil of lubricating viscosity, from 0.1% to 6% by weight of the unsulfurized, carboxylate-containing additive of the present invention, and preferably at least one other additive.

Additive Concentrates

Additive concentrates are also included within the scope of this invention. The concentrates of this invention comprise the compounds or compound mixtures of the present invention, with at least one of the additives disclosed above. Typically, the concentrates contain sufficient organic diluent to make them easy to handle during shipping and storage.

From 20% to 80% of the concentrate is organic diluent. From 0.5% to 80% of the concentrate is the unsulfurized, carboxylate-containing additive of the present invention. The unsulfurized, carboxylate-containing additive contains the single-aromatic-ring hydrocarbyl salicylate, and possibly hydrocarbyl phenol and hydrocarbyl phenate. The remainder of the concentrate consists of other additives.

Suitable organic diluents that can be used include mineral oil or synthetic oils, as described above in the section entitled "Base Oil of Lubricating Viscosity." The organic diluent preferably has a viscosity of from about 1 to about 20 cSt at 100° C.

Examples Of Additive Packages

Below are representative examples of additive packages that can be used in a variety of applications. These representative examples employ the unsulfurized, carboxylate-containing additive of the present invention. The unsulfurized, carboxylate-containing additive contains the single-aromatic-ring hydrocarbyl salicylate, and possibly hydrocarbyl phenol and hydrocarbyl phenate. The unsulfurized, carboxylate-containing additive may be used either with or without other metal-containing detergents, depending upon the desired BN of the final product. The following percentages are based on the amount of active component, with neither process oil nor diluent oil, but including sufficient metal-containing detergents (including other types of metal detergents) to achieve the desired BN. These examples are provided to illustrate the present invention, but they are not intended to limit it.

I. Marine Diesel Engine Oils

| | | |
|---|---|---|
| 1) | Unsulfurized, carboxylate-containing additive | 65% |
| | Primary alkyl zinc dithiophosphate | 5% |
| | Oil of lubricating viscosity | 30% |
| 2) | Unsulfurized, carboxylate-containing additive | 65% |
| | Alkenyl succinimide ashless dispersant | 5% |
| | Oil of lubricating viscosity | 30% |
| 3) | Unsulfurized, carboxylate-containing additive | 60% |
| | Primary alkyl zinc dithiophosphate | 5% |
| | Alkenyl succinimide ashless dispersant | 5% |
| | Oil of lubricating viscosity | 30% |
| 4) | Unsulfurized, carboxylate-containing additive | 65% |
| | Phenol type oxidation inhibitor | 10% |
| | Oil of lubricating viscosity | 25% |
| 5) | Unsulfurized, carboxylate-containing additive | 55% |
| | Alkylated diphenylamine-type oxidation inhibitor | 15% |
| | Oil of lubricating viscosity | 30% |
| 6) | Unsulfurized, carboxylate-containing additive | 65% |
| | Phenol-type oxidation inhibitor | 5% |
| | Alkylated diphenylamine-type oxidation inhibitor | 5% |
| | Oil of lubricating viscosity | 25% |
| 7) | Unsulfurized, carboxylate-containing additive | 60% |
| | Primary alkyl zinc dithiophosphate | 5% |
| | Phenol-type oxidation inhibitor | 5% |
| | Oil of lubricating viscosity | 30% |
| 8) | Unsulfurized, carboxylate-containing additive | 60% |
| | Alkenyl succinimide ashless dispersant | 5% |
| | Alkylated diphenylamine-type oxidation inhibitor | 10% |
| | Oil of lubricating viscosity | 25% |
| 9) | Unsulfurized, carboxylate-containing additive | 55% |
| | Other additives | 25% |
| | Primary alkyl zinc dithiophosphate | |
| | Alkenyl succinic ester ashless dispersant | |
| | Phenol-type oxidation inhibitor | |
| | Alkylated diphenylamine-type oxidation inhibitor | |
| | Oil of lubricating viscosity | 30% |

II. Motor Car Engine Oils

| | | |
|---|---|---|
| 1) | Unsulfurized, carboxylate-containing additive | 25% |
| | Alkenyl succinimide ashless dispersant | 35% |
| | Primary alkyl zinc dithiophosphate | 10% |
| | Oil of lubricating viscosity | 30% |
| 2) | Unsulfurized, carboxylate-containing additive | 20% |
| | Alkenyl succinimide ashless dispersant | 40% |
| | Secondary alkyl zinc dithiophosphate | 5% |
| | Dithiocarbamate type oxidation inhibitor | 5% |
| | Oil of lubricating viscosity | 30% |
| 3) | Unsulfurized, carboxylate-containing additive | 20% |
| | Alkenyl succinimide ashless dispersant | 35% |
| | Secondary alkyl zinc dithiophosphate | 5% |
| | Phenol type oxidation inhibitor | 5% |
| | Oil of lubricating viscosity | 35% |
| 4) | Unsulfurized, carboxylate-containing additive | 20% |
| | Alkenyl succinimide ashless dispersant | 30% |
| | Secondary alkyl zinc dithiophosphate | 5% |
| | Dithiocarbamate type anti-wear agent | 5% |
| | Oil of lubricating viscosity | 40% |
| 5) | Unsulfurized, carboxylate-containing additive | 20% |
| | Succinimide ashless dispersant | 30% |
| | Secondary alkyl zinc dithiophosphate | 5% |
| | Molybdenum-containing anti-wear agent | 5% |
| | Oil of lubricating viscosity | 40% |
| 6) | Unsulfurized, carboxylate-containing additive | 20% |
| | Alkenyl succinimide ashless dispersant | 30% |
| | Other additives | 10% |
| | Primary alkyl zinc dithiophosphate | |
| | Secondary alkyl zinc dithiophosphate | |
| | Alkylated diphenylamine-type oxidation inhibitor | |
| | Dithiocarbamate type anti-wear agent | |
| | Oil of lubricating viscosity | 40% |

-continued

| | | |
|---|---|---|
| 7) | Unsulfurized, carboxylate-containing additive | 60% |
| | Other additives | 10% |
| | Phenol type oxidation inhibitor | |
| | Alkylated diphenylamine-type | |
| | Oxidation inhibitor | |
| | Dithiocarbamate type anti-wear agent | |
| | Demulsifier | |
| | Boron-containing friction modifier | |
| | Oil of lubricating viscosity | 30% |
| III. Hydraulic Oils | | |
| 1) | Unsulfurized, carboxylate-containing additive | 20% |
| | Primary alkyl zinc dithiophosphate | 50% |
| | Other additives | 25% |
| | Phenol type oxidation inhibitor | |
| | Phosphorus-containing extreme pressure agent | |
| | Triazol type corrosion inhibitor | |
| | Demulsifier | |
| | Nonionic anti-rust agent | |
| | Oil of lubricating viscosity | 5% |
| 2) | Unsulfurized, carboxylate-containing additive | 10% |
| | Primary alkyl zinc dithiophosphate | 40% |
| | Other additives | 47% |
| | Phenol type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 3% |
| 3) | Unsulfurized, carboxylate-containing additive | 10% |
| | Phosphorus-containing extreme pressure agent | 40% |
| | Phenol type oxidation inhibitor | 15% |
| | Other additives | 25% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 10% |
| 4) | Unsulfurized, carboxylate-containing additive | 20% |
| | Phosphorus-containing extreme pressure agent | 30% |
| | Other additives | 45% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 5% |
| IV. Transmission Hydraulic Fluids | | |
| 1) | Unsulfurized, carboxylate-containing additive | 35% |
| | Primary alkyl zinc dithiophosphate | 20% |
| | Polyol type friction modifier | 20% |
| | Sulfur-containing extreme pressure agent | 5% |
| | Oil of lubricating viscosity | 20% |
| 2) | Unsulfurized, carboxylate-containing additive | 40% |
| | Primary alkyl zinc dithiophosphate | 15% |
| | Amide type friction modifier | 15% |
| | Sulfur-containing extreme pressure agent | 5% |
| | Oil of lubricating viscosity | 25% |
| 3) | Unsulfurized, carboxylate-containing additive | 30% |
| | Primary alkyl zinc dithiophosphate | 20% |
| | Other additives | 30% |
| | Alkenyl succinimide ashless dispersant | |
| | Amide type friction modifier | |
| | Ester type friction modifier | |
| | Phosphorus, Sulfur-containing extreme pressure agent | |
| | Oil of lubricating viscosity | 20% |
| 4) | Unsulfurized, carboxylate-containing additive | 35% |
| | Primary alkyl zinc dithiophosphate | 15% |
| | Other additives | 25% |
| | Polyol type friction modifier | |
| | Amide type friction modifier | |
| | Phosphorus, Sulfur-containing extreme pressure agent | |
| | Oil of lubricating viscosity | 25% |

EXAMPLES

The invention will be further illustrated by following examples, which set forth particularly advantageous method embodiments. While the Examples are provided to illustrate the present invention, they are not intended to limit it.

Example 1

Preparation of the Novel Unsulfurized, Carboxylate-Containing Additive

An intermediate product was prepared according to the procedure given in U.S. Pat. No. 6,162,770, Example 1. Said procedure is reproduced here:

A. Neutralization

A charge of 875 g of branched dodecylphenol (DDP) having a molecular mass of 270, (i.e. 3.24 moles) and 875 g of linear alkylphenol having a molecular mass of about 390 (i.e. 2.24 moles) was placed in a four-necked 4 liter glass reactor above which was a heat-insulated Vigreux fractionating column. The isomeric molar repartition of para versus ortho alkylphenol was:

DDP: 89% para and 5.5% ortho

Linear alkylphenol: 39% para and 53% ortho.

The agitator was started up and the reaction mixture was heated to 65° C., at which temperature 158 grams of slaked lime $Ca(OH)_2$ (i.e. 2.135 moles) and 19 g of a mixture (50/50 by weight) of formic acid and acetic acid were added.

The reaction medium underwent further heating to 120° C. at which temperature the reactor was placed under a nitrogen atmosphere, then heated up to 165° C. and then the nitrogen introduction was stopped. Distillation of water commenced at this temperature.

The temperature was increased to 240° C. and the pressure was reduced gradually below atmospheric until an absolute pressure of 5,000 Pa (50 mbars) was obtained.

The reaction mixture was kept for five hours under the preceding conditions. The reaction mixture was allowed to cool to 180° C., then the vacuum was broken under a nitrogen atmosphere and a sample was taken for analysis. The total quantity of distillate obtained was about 120 $cm^3$; demixing took place in the lower phase (66 $cm^3$ being water).

B. Carboxylation:

The product obtained in Step (A) was transferred to a 3.6-liter autoclave and heated to 180° C.

At this temperature, scavenging of the reactor with carbon dioxide ($CO_2$) was commenced and continued for ten minutes. The amount of $CO_2$ used in this step was in the order of 20 grams.

After the temperature had been raised to 200° C., the autoclave was closed, leaving a very small leak, and the introduction of $CO_2$ was continued so as to maintain a pressure of $3.5\times10^5$ Pa (3.5 bars) for 5 hours at 200° C. The amount of $CO_2$ introduced was in the order of 50 grams. After the autoclave had been cooled to 165° C., the pressure was restored to atmospheric and the reactor was then purged with nitrogen.

A total quantity of 1,912 grams of product was recovered prior to filtration. The product was then filtered.

The above procedure was scaled up to a 6000 gallon reactor and used to prepare the intermediate product. The intermediate product was then subjected to the additional step of distillation outlined below.

Analytical results for the intermediate product from the 6000 gallon batch were as follows:

| | |
|---|---|
| TBN | 116 mg KOH/gm |
| Calcium | 4.1 wt % |
| Salicylic Acid Index (SAI) | 40 mg KOH/gm |

SAI is a measure of the quantity of alkylsalicylate formed in the detergent-dispersant. It was determined by acidification of the product by a strong acid (hydrochloric acid) in the presence of diethyl ether, followed by a potentiometric titration on the organic fraction (tetra n-butyl ammonium hydroxide was used as a titration agent). Results are expressed in equivalent mg KOH per gram of product (Base Number unit).

Distillation:

The intermediate product was fed at a rate of 70 kg/hr to a wiped film evaporator (WFE) which had a surface area of 0.39 $m^2$. The WFE had an internal condenser and entrainment separator along with a hot oil jacket. The hot oil temperature in the jacket was about 250° C. The pressure within the WFE was 1.3 mbar. The feed temperature to the WFE was 135° C. Final product temperature exiting the WFE was 222° C. The product was cooled to less than 100° C. before diluting with 100N base oil. Approximately 47.5% (by weight) of the feed to the WFE was collected as distillate. The amount of distillate collected may vary from 10% up to about 55% by weight of the feed to the WFE. Depending upon the level of distillation, enough organic diluent is then added to the distilled product to give a manageable viscosity. As the weight percentage of feed collected as distillate increases, the amount of diluent needed to be added to the distilled product in order to give a manageable viscosity increases.

Analytical results for the distilled product were as follows:

| | |
|---|---|
| TBN | 174 mg KOH/gm |
| Ca | 6.09 wt % |
| Salicylic Acid Index (SAI) | 58 |
| Viscosity at 100° C. | 705 cSt |
| Oil Content (by mass balance) | 21.5 wt % |

It is well known in the art that salicylate structures are thermally unstable. As the distilled material had a comparable Salicylic Acid Index to calcium ratio as the feedstock, no decomposition of the salicylate structure occurred even though the feed was exposed to relatively high temperatures. No decomposition occurred as the residence time in the WFE is relatively short.

The distillate appearance was clear and slightly yellow which is comparable to the appearance of the starting hydrocarbyl phenols introduced in the neutralization step. The TBN content of the distillate was essentially zero indicating than none of the feedstock to the distillation step carried over into the distillate. The distillate was analyzed by gas chromatography and found to contain approximately 61% branched hydrocarbyl phenol, 39% linear hydrocarbyl phenol, and 6% 100N base oil.

Example 2

The pre-distillation product prepared according to Example 1 was distilled under various conditions in the WFE described above. Typical results for other distillation conditions are shown in Table 1.

TABLE 1

| | 1 | 2 |
|---|---|---|
| WFE Conditions: | | |
| Feed Rate (kg/hr) | 122 | 86 |
| Pressure (mbar) | 1.44 | 1.5 |
| Hot Oil Temp (° C.) | 235 | 254 |
| Product Temperature Exiting Evaporator (° C.) | 205 | 222 |
| Amount of Distillate (wt %)[1] | 30 | 43 |
| Oil in Final Product (wt %) | 0 | 14.5 |
| Product Analytical Results | | |
| TBN (mg KOH/gm) | 166 | 174 |
| Ca (wt %) | 5.92 | 6.2 |
| SAI (mg KOH/gm) | 57 | 59 |
| Viscosity @ 100° C. (cSt) | 226 | 575 |
| Compostion of Distillate | | |
| Branched Alkylphenol (wt %) | 76 | 64 |
| Linear Alkylphenol (wt %) | 15 | 27 |
| 100N Base Oil (wt %) | 9 | 9 |

[1]Based on WFE Feed Rate

Example 3

Example 1 was repeated except for the following changes:

a) The WFE had a surface area of 0.78 $m^2$ b) The feed rate to the WFE was about 135 kg/hr c) The final distilled product was diluted with about 36 wt % 100N oil to produce a product with a manageable viscosity.

Similar to Example 1, about 46% (based on weight) of the feed to the evaporator was collected as distillate.

Analytical results for this product are as follows:

| | |
|---|---|
| TBN | 138 mg KOH/gm |
| Calcium | 4.96 wt % |
| SAI | 47 mg KOH/gm |

Dialysis was performed on about 15 gm of product from Example 3 using a Soxhlet extraction apparatus (pentane solvent) and a Latex membrane condom for about 24 hours to afford a dialysate fraction (the material that passes through the membrane) and a residue fraction (the material left in the latex membrane bag).

The dialysate fraction from the dialysis procedure was separated into two fractions using silica gel chromatography (0.2–0.25 gm on two Silica Gel Cartridges—Waters Part No. 051900) first using 12 ml of hexane to yield Fraction 1 followed by reversing the Cartridges and flushing with 12 ml of 80:20 Ethyl Acetate: Ethanol to afford Fraction 2. Fraction 1 was comprised of diluent oil and Fraction 2 was comprised of free alkylphenols.

The Fraction 2 obtained from the chromatographic separation procedure was analyzed using supercritical chromatography (SFC) to determine the amount of branched alkylphenol and linear alkylphenol present. Quantification was performed using a calibration curve of known mixtures of branched and linear alkylphenol. % SA was determined on the dialysis residue fraction by acidification of the product by a strong acid (hydrochloric acid) in the presence of diethyl ether, followed by a potentiometric titration on the organic fraction (tetra n-butyl ammonium hydroxide was used as a titration agent). This method separates and quantifies the alkyl salicylic acid and the remaining alkylphenol (non-carboxylated alkylphenate). Results were expressed in equivalent mg KOH per gram of product (Base Number unit). % SA was then determined by using the following equation:

% SA = 100*(Alkylsalicylic acid/(Alkylphenol + Alkylsalicylic acid))

% Ca in the residue was determined by classical X Ray spectrometry.

Dialysis results are as follows:

| | |
|---|---|
| Dialysate | 51.1 wt % of starting sample weight |
| Residue | 48.9 wt % of starting sample weight |
| Dialysate Composition: | |
| Dodecylphenol | 1.0 wt % |
| Linear Alkylphenol | 26.7 wt % |
| 100N Base Oil | 72.3 wt % |
| Residue Composition | |
| Calcium | 9.3 wt % |
| TBN | 259 mg KOH/gm |
| SAI | 78 mg KOH/gm |
| % SA | 50 |

The following composition of the product produced in Example 3 was calculated from the composition of the dialysate and residue fractions:

| | |
|---|---|
| Total Alkylphenol Content | 14.1 wt % |
| Oil | 36.9 wt % |
| Single Aromatic Ring Alkylsalicylate | 24.5 wt % |
| Calcium Alkylphenate | 24.5 wt % |

Procedures for Performance Tests

The following Section describes Performance Test Methods referred to in these examples.

Bulk Oxidation (MIP-48)

The Modified IP-48 test (or MIP-48 test) is a bulk oil oxidation test. The IP-48 test is test method 48 of the Institute of Petroleum and can be found in "Standard methods for analysis and testing of petroleum and related products and British Standard 2000 parts, 2000, Methods IP-1-324, Volume 1" published on behalf of the institute of petroleum (London) by John Wiley & Sons, LTD (Chisester, N.Y., Weinheim, Brisbane, Singapore, Toronto). In said test, air is bubbled through a lubricant sample which is kept at high temperature. The viscosity of the end-of-test sample is compared to that of a reference sample which has the exact same composition but is bubbled through with nitrogen. The net viscosity increase (expressed as a percentage increase) is an indication for the oxidation stability of a lubricant. The lower the viscosity increase, the better.

Corrosion Control (ASTM D6594-01)

This is a standard test method for evaluation of corrosiveness of diesel engine oil at 135° C. This test method is used to test diesel engine lubricants to determine their tendency to corrode various metals, specifically alloys of lead and copper commonly used in cam followers and bearings. Four metal specimens of copper, lead, tin, and phosphor bronze are immersed in a measured amount of engine oil. The oil, at an elevated temperature, is blown with air for a period of time. When the test is completed, the copper specimen and the stressed oil are examined to detect corrosion and corrosion products, respectively.

Examples Showing Performance Advantages

The following Examples illustrate performance advantages demonstrated by lubricating oil compositons containing the unsulfurized carboxylate-containing additive of the present invention.

Example 4

Marine Engine Oils Performance

The lubrication oil formulations used in the present example were generated for lubricants intended for use in Marine Trunk Piston Engines and had the following compositions:

| | |
|---|---|
| **Formula 1** | |
| Phenate-Stearate | 6.04% |
| Zinc Dithiophosphate | 0.64% |
| Foam Inhibitor | 0.04% |
| Commercial detergent-dispersant | 14.72% |
| **Formula 1A** | |
| Phenate-Stearate | 6.04% |
| Zinc Dithiophosphate | 0.64% |
| Foam Inhibitor | 0.04% |
| Unsulfurized, carboxylate-containing additive prepared according to Example 1 | 10.17% |
| **Formula 2** | |
| Phenate | 7.22% |
| Zinc Dithiophosphate | 0.64% |
| Foam Inhibitor | 0.04% |
| Commercial detergent-dispersant | 16.83% |
| **Formula 2A** | |
| Phenate | 7.22% |
| Zinc Dithiophosphate | 0.64% |
| Foam Inhibitor | 0.04% |
| Unsulfurized, carboxylate-containing additive prepared according to Example 1 | 11.05% |
| **Formula 3** | |
| HOB Salicylate | 8.93% |
| Zinc Dithiophosphate | 0.64% |
| Foam Inhibitor | 0.04% |
| MOB Salicylate | 8.88% |
| **Formula 3A** | |
| HOB Salicylate | 8.93% |
| Zinc Dithiophosphate | 0.64% |
| Foam Inhibitor | 0.04% |
| Unsulfurized, carboxylate-containing additive prepared according to Example 1 | 8.72% |
| **Formula 4A** | |
| Carboxy-Stearate | 8.83% |
| Zinc Dithiophosphate | 0.64% |
| Foam Inhibitor | 0.04% |
| Unsulfurized, carboxylate-containing additive prepared according to Example 1 | 8.72% |

The treat rates of these concentrated additives in finished oil were adjusted to ensure a BN of 40 mg KOH/g according to ASTM D2896 for the finished lubricant.

Results of Bulk Oxidation Test

| | Formula 1 | Formula 1A | Formula 2 | Formula 2A | Formula 3 | Formula 3A | Formula 4A |
|---|---|---|---|---|---|---|---|
| MIP-48 results | 39 | 17 | 45 | 25 | 24 | 22 | 20 |

The results of the MIP-48 bulk oxidation test show that the unsulfurized, carboxylate-containing additive of the present invention has surprisingly better viscosity increase control (VIC) compared to a commercial detergent-dispersant when tested at the same BN level in the same formulation.

Example 5

Automotive Performance

The lubrication oil formulations used in the present example were designed for Low Emission Diesel Lubricants (LEDL) intended for use in Low Emission Diesel Engines and had the following compositions:

| Baseline Formulation | A | A | B | B | C | C |
|---|---|---|---|---|---|---|
| Sulfated Ash, % | 0.95 | 0.95 | 1.0 | 1.0 | 1.0 | 1.0 |
| Sulphur, % | 0.10 | 0.10 | 0.12 | 0.12 | 0.10 | 0.10 |
| Phosphorus, % | 0.05 | 0.05 | 0.05 | 0.05 | 0.05 | 0.05 |
| Borated Dispersant | Y | Y | Y | Y | Y | Y |
| Non-Borated Dispersant | Y | Y | Y | Y | Y | Y |
| LOB Ca-Sulfonate | N | N | Y | Y | N | N |
| LOB Salicylate | N | N | N | N | Y | Y |
| Commercially Available Salicylate, wt % | 4.5 | N | 4.5 | N | 4.5 | N |
| Unsulfurized, carboxylate-containing additive prepared according to Example 1 | N | 5.0 | N | 5.0 | N | 5.0 |
| Secondary ZnDTP | Y | Y | Y | Y | Y | Y |
| Diphenylamine Anti-Oxidant | Y | Y | Y | Y | Y | Y |
| Molybdenum Anti-Oxidant | Y | Y | Y | Y | Y | Y |
| Foam Inhibitor | Y | Y | Y | Y | Y | Y |
| OCP VII | Y | Y | Y | Y | Y | Y |
| Base Oil 1 | Y | Y | Y | Y | Y | Y |
| Base Oil 2 | Y | Y | Y | Y | Y | Y |
| HTCBT | | | | | | |
| Pb, ppm | 118 | 60 | 140 | 74 | 230 | 108 |

For each formulation, the unsulfurized, carboxylate-containing additive of the present invention was compared to a commercially available salicylate for corrosion performance. In each case, covering a range of sulfur, phosphorus and ash levels, the carboxylate-containing additive of the present invention displayed superior corrosion control performance.

While the present invention has been described with reference to specific embodiments, this application is intended to cover those various changes and substitutions that may be made by those skilled in the art without departing from the spirit and scope of the appended claims.

What is claimed is:

1. A method for producing an unsulfurized, carboxylate-containing additive for lubricating oils, said method comprising:

(a) neutralization of hydrocarbyl phenols using an alkaline earth base in the presence of a promoter, to produce a hydrocarbyl phenate;

(b) carboxylation of the hydrocarbyl phenate obtained in step (a) using carbon dioxide under carboxylation conditions sufficient to convert at least 20 mole% of the starting hydrocarbyl phenols to hydrocarbyl salicylate; and (c) separation of at least about 10% of the starting hydrocarbyl phenols from the product produced in step (b) to produce said additive.

2. A method for producing an unsulfurized, carboxylate-containing additive for lubricating oils according to claim 1, wherein said hydrocarbyl salicylate comprises single-aromatic-ring hydrocarbyl salicylate and double-aromatic-ring hydrocarbyl salicylate wherein the mole ratio of single aromatic-ring hydrocarbyl salicylate to double-aromatic-ring hydrocarbyl salicylate is at least 8:1.

3. A method for producing an unsulfurized, carboxylate-containing additive for lubricating oils according to claim 1, wherein, in said separation step, at least about 30% of the starting hydrocarbyl phenols is separated from the product produced in step (b) to produce said additive.

4. A method for producing an unsulfurized, carboxylate-containing additive for lubricating oils according to claim 1, wherein, in said separation step, up to 55% of the starting hydrocarbyl phenols is separated from the product produced in step (b) to produce said additive.

5. A method for producing an unsulfurized, carboxylate-containing additive for lubricating oils according to claim 1, wherein, in said separation, step about 45% to about 50% of the starting hydrocarbyl phenols is separated from the product produced in step (b) to produce said additive.

6. A method for producing an unsulfurized, carboxylate-containing additive for lubricating oils according to claim 1, wherein, in said separation step, said starting hydrocarbyl phenols are removed by distillation.

7. A method for producing an unsulfurized, carboxylate-containing additive for lubricating oils according to claim 6, wherein, in said separation step, at least about 30% of the starting hydrocarbyl phenols is separated from the product produced in step (b) to produce said additive.

8. A method for producing an unsulfurized, carboxylate-containing additive for lubricating oils according to claim 6, wherein, in said separation step, up to 55% of the starting hydrocarbyl phenols is separated from the product produced in step (b) to produce said additive.

9. A method for producing an unsulfurized, carboxylate-containing additive for lubricating oils according to claim 6, wherein, in said separation step, about 45% to about 50% of the starting hydrocarbyl phenols is separated from the product produced in step (b) to produce said additive.

10. A method for producing an unsulfurized, carboxylate-containing additive for lubricating oils according to claim 6, wherein said distillation is accomplished via falling film distillation, wiped film evaporator distillation, or shod path distillation.

11. A method for producing an unsulfurized, carboxylate-containing additive for lubricating oils according to claim 10, wherein said distillation is carried out at temperatures ranging from about 150° C. to about 250° C. and at pressures from about 0,1 to about 4 mbar.

12. A method for producing an unsulfurized, carboxylate-containing additive for lubricating oils according to claim 10, wherein said distillation is carried out at temperatures ranging from about 190° C. to about 230° C. and at pressures from about 0.5 to about 3 mbar.

13. A method for producing an unsulfurized, carboxylate-containing additive for lubricating oils according to claim 10, wherein said distillation is carried out at temperatures ranging from about 195° C. to about 225° C., and at a pressure of about 1 to about 2 mbar.

14. A method for producing an unsulfurized, carboxylate-containing additive for lubricating oils according to claim 1, wherein an effective viscosity improving amount of organic diluent is added to said additive.

15. A method for producing an unsulfurized, carboxylate-containing additive for lubricating oils according to claim 1, wherein, after said separation step, said starting hydrocarbyl phenols are recycled.

16. A method for producing an unsulfurized, carboxylate-containing additive for lubricating oils according to claim 1, wherein, in said neutralization step;

(a) said neutralization operation is carried out in the presence of at least one carboxylic acid containing from one to four carbon atoms, and in the absence of alkali base, dialcohol, and monoalcohol; and (b) said neutralization operation is carried out at a temperature of at least 200° C.;

(c) the pressure is reduced gradually below atmospheric in order to remove the water of reaction, in the absence of any solvent that may form an azeotrope with water;

(d) said hydrocarbyl phenols contain up to 85% of linear hydrocarbyl phenol in mixture with at least 15% of branched hydrocarbyl phenol in which the branched hydrocarbyl radical contains at least nine carbon atoms; and (e) the quantities of reagents used correspond to the following molar ratios:

(1) alkaline earth base/hydrocarbyl phenol of 02:1 to 0.7:1; and (2) carboxylic acid/hydrocarbyl phenol of from 0.01:1 to 0.5:1.

17. A method for producing an unsulfurized, carboxylate-containing additive for lubricating oils according to claim 16, wherein said hydrocarbyl phenols are alkylphenols.

18. A method for producing an unsulfurized, carboxylate-containing additive for lubricating oils according to claim 17, wherein, in said separation step, said starting hydrocarbyl phenols are removed by distillation.

19. A lubricating oil additive produced by the method according to claim 1.

20. A lubricant additive composition comprising the lubricating oil additive of claim 19 and at least one of the following:

(a) a phenate;

(b) a phenate-stearate;

(c) a salicylate; and (d) a carboxy-stearate.

21. The composition of claim 20 wherein the mass ratio of phenate to said lubricating oil additive is from 1:0.035 to 1:98.

22. The composition of claim 20 wherein the mass ratio of phenate to said lubricating oil additive is from 1:0.239 to 1:14.

23. The composition of claim 20 wherein the mass ratio of phenate to said lubricating oil additive is from 1:0.451 to 1:75.

24. The composition of claim 20 wherein the mass ratio of phenate-stearate to said lubricating oil additive is from 1:0.051 to 1:126.

25. The composition of claim 20 wherein the mass ratio of phenate-stearate to said lubricating oil additive is from 1:0353 to 1:18.

26. The composition of claim 20 wherein the mass ratio of phenate-stearate to said lubricating oil additive is from 1:0.667 to 1:9.7.

27. The composition of claim 20 wherein said salicylate is a medium-overbased salicylate.

28. The composition of claim 20 wherein said salicylate is a high-overbased salicylate.

29. The composition of claim 28 wherein the mass ratio of salicylate to said lubricating oil additive is from 1:0026 to 1:120.

30. The composition of claim 28 wherein the mass ratio of salicylate to said lubricating oil additive is from 1:0.178 to 1:17.

31. The composition of claim 28 wherein the mass ratio of salicylate to said lubricating oil additive is from 1:0.335 to 1:9.2.

32. The composition of claim 20 wherein the mass ratio of carboxy-stearate to said lubricating oil additive is from 1:0.023 to 1:105.

33. The composition of claim 20 wherein the mass ratio of carboxy-stearate to said lubricating oil additive is from 1:0.156 to 1:15.

34. The composition of claim 20 wherein the mass ratio of carboxy-stearate to said lubricating oil additive is from 1:0.294 to 1:8.1.

35. A lubricating oil composition comprising;

(a) a major part of a base oil of lubricating viscosity; and (b) from about 1% to about 30% of the lubricating oil additive according to claim 19.

36. A lubricating oil composition according to claim 35 further comprising at least one of the following:

(a) an ashless dispersant (b) an oxidation inhibitor;

(c) a rust inhibitor (d) a demulsifier;

(e) an extreme pressure agent;

(f) a friction modifier;

(g) a multifunctional additive;

(h) a viscosity index improver;

(i) a pour point depressant;

(j) a foam inhibitor; and (k) a metal-containing detergent.

37. A hydraulic oil composition containing a major part of a base oil of lubricating viscosity and from about 0.1 to about 6.0% of the lubricating oil additive according to claim 19.

38. A concentrate comprising:

(a) from 20% to 80% of an organic diluent; and (b) the lubricating oil additive according to claim 19.

39. An additive package comprising the lubricating oil additive according to claim 19 and further comprising at least one of the following:

(a) a metal-containing detergent;
(b) an ashless dispersant;
(c) an oxidation inhibitor;
(d) a rust inhibitor;
(e) a demulsifier;
(f) an extreme pressure agent;
(g) a friction modifier;
(h) a multifunctional additive;
(i) a viscosity index improver;
(j) a pour point depressant; and
(k) a foam inhibitor.

40. A method for improving corrosion protection in an internal combustion engine, said method comprising operating an internal combustion engine with the lubricating oil composition according to claim 35.

41. A method for improving viscosity increase control of a lubricating oil composition, said method comprising adding an effective viscosity increase controlling amount of the lubricating oil additive according to claim 19, to said lubricating oil composition.

42. A method for producing an unsulfurized, carboxylate-containing additive for lubricating oils according to claim 1, wherein the product produced in step (b) is filtered to remove any sediment.

* * * * *